US007527562B1

(12) United States Patent
Mason

(10) Patent No.: US 7,527,562 B1
(45) Date of Patent: May 5, 2009

(54) METHOD AND DEVICES FOR AIMING AND ALIGNING FOR A GOLF SHOT

(76) Inventor: John V. Mason, 329 Lockport St., Youngstown, NY (US) 14174

( * ) Notice: Subject to any disclaimer, the term of this patent is extended or adjusted under 35 U.S.C. 154(b) by 111 days.

(21) Appl. No.: 11/331,714

(22) Filed: Jan. 13, 2006

Related U.S. Application Data

(60) Provisional application No. 60/593,446, filed on Jan. 14, 2005.

(51) Int. Cl.
*A63B 69/36* (2006.01)

(52) U.S. Cl. ..... 473/257; 473/218; 473/270; 473/278

(58) Field of Classification Search ..... 473/218, 473/257, 270, 271, 272, 273, 278, 279
See application file for complete search history.

(56) References Cited

U.S. PATENT DOCUMENTS

| | | | | |
|---|---|---|---|---|
| 1,484,390 | A | 2/1924 | Gibbs et al. | |
| 2,707,638 | A | 5/1955 | Manley | |
| 2,777,697 | A | 1/1957 | Crossot | |
| 3,122,846 | A | 3/1964 | Trent | |
| 3,510,135 | A * | 5/1970 | Gentile | 473/270 |
| 3,658,344 | A * | 4/1972 | Kimble | 473/272 |
| D225,242 | S | 11/1972 | Pruitt | |
| 4,000,905 | A | 1/1977 | Shirhall | |
| 4,023,810 | A | 5/1977 | Lorang | |
| D249,077 | S | 8/1978 | Friskel | |
| 4,164,352 | A | 8/1979 | O'Brien | |
| 4,248,431 | A | 2/1981 | Burnes | |
| 4,355,810 | A | 10/1982 | Rydeck | |
| 4,384,718 | A * | 5/1983 | Cachola | 473/218 |
| 4,434,983 | A | 3/1984 | Taggart | |
| 4,538,815 | A * | 9/1985 | Poirier | 473/218 |
| 4,805,913 | A | 2/1989 | Bott | |
| 4,915,387 | A | 4/1990 | Baxstrom | |
| 5,035,433 | A | 7/1991 | Durso | |
| 5,071,130 | A * | 12/1991 | Shofner | 473/218 |
| 5,108,106 | A * | 4/1992 | Cook | 473/272 |
| 5,163,686 | A | 11/1992 | Bergman | |
| D335,696 | S | 5/1993 | Byers et al. | |
| 5,306,011 | A | 4/1994 | Perry | |
| 5,478,082 | A | 12/1995 | De Knight et al. | |
| 5,492,328 | A | 2/1996 | Lundquist | |
| 5,611,738 | A | 3/1997 | Lundquist | |
| 5,645,494 | A | 7/1997 | Dionne et al. | |
| 6,050,902 | A | 4/2000 | McCrink Jr. | |
| 6,077,169 | A | 6/2000 | Florian | |
| 6,396,041 | B1 | 5/2002 | Vock et al. | |
| 6,482,102 | B2 | 11/2002 | Grabowski | |
| 6,592,376 | B1 | 7/2003 | Carpenter | |
| 6,723,004 | B1 | 4/2004 | Florian | |
| 2001/0036869 | A1 | 11/2001 | Grabowski | |
| 2004/0077430 | A1 | 4/2004 | Mindlin | |
| 2005/0197199 | A1 * | 9/2005 | Cardosi | 473/257 |

* cited by examiner

*Primary Examiner*—Nini Legesse
(74) *Attorney, Agent, or Firm*—Simpson & Simpson, PLLC

(57) ABSTRACT

The present invention is a device for aiming and aligning a golf shot. The device includes longitudinal and transverse portions and ball position holes in the longitudinal portion. At least one end of the transverse portion includes cutouts for positioning the feet of a golf shot and setting up in proper address position. The invention also includes a golf training mat for coaching a golfer in proper aim and alignment of a golf shot and setting up in proper address position. The invention also includes a method for consistently setting up in a proper aiming and alignment position using the aiming and alignment device.

10 Claims, 12 Drawing Sheets

METHOD AND DEVICES FOR AIMING AND ALIGNING FOR A GOLF SHOT

CROSS-REFERENCE TO RELATED APPLICATIONS

The present application claims benefit under 35 U.S.C. § 119 (e) of U.S. Provisional Patent Application Ser. No. 60/593,446 filed Jan. 14, 2005.

FIELD OF THE INVENTION

The present invention relates generally to devices that aid in the development of a consistent golf shot. More particularly, the present invention is directed toward a method and a device to aid in development of proper stance and target alignment for hitting a golf shot. Still more particularly, the present invention is drawn to a golf training mat and aiming device that may be for use by golfers of different heights and using different clubs to teach proper stance and swing path.

BACKGROUND OF THE INVENTION

Golf is a popular game played by millions of people in the U.S. and by millions more around the world. To a non-golfer, golf may appear to be a deceptively simple game—there is no moving target as in baseball nor is there any interference from opposing players as in football, basketball, or hockey. However, to the typical golfer, golf is not only difficult, but frustrating. For the amateur, and often even for the professional, a good shot is followed by a poor shot that unravels all the effects of the previous shot. For example, a 250 yard drive into the middle of the fairway is followed by a 100 yard slice into the middle of a water hazard. One primary cause for this common problem is an inconsistent setup or address by the golfer combined with incorrect target alignment which, even with a good swing, produces an offline shot that can cause the ball land far to the right or left of the target.

The popularity of golf, coupled with the frustration it generates, has led to the development of a myriad of training devices to improve swing technique, stance, and foot position. U.S. Patent Publication No. 2004/0077430 to Mindlin discloses a training mat that includes removable markers to layout proper foot placement for the golf student. However, the disclosed mat markers must be changed for different golfers and even for different clubs that are used by the same golfer. It also provides no indicia for aiding in proper target alignment. U.S. Pat. No. 6,482,102 to Grabowski discloses a golf learning and guide mat in which a series of footprints are attached to or placed on the mat for different clubs. However, similar to the '430 publication, the mat appears to be designed for customized use in that it provides for a foot print pattern for only a single golfer. U.S. Pat. No. 6,077,169 to Florian discloses a golf training mat comprising a series of footprints for indicating the proper foot position when using different clubs. However, it lacks any indicia to aid adjustment for an individual golfer's height and any type of alignment pattern to ensure the golf club is swung along the proper swing path.

U.S. Pat. No. 5,306,011 to Perry discloses a golf swing training device comprising four groups of lines to indicate correct position for the feet, hands, and golf club. However, it lacks any positioning indicator for a golfer's eyes, spine angle (important for proper stance) and any type of swing path guide. U.S. Pat. No. 5,163,686 to Bergman includes indicators for stance for both different clubs and golfers of different heights, but it lacks a target line for more than one type of club.

U.S. Pat. No. 4,915,387 to Baxstrom comprises a training mat that includes a plurality of footprints for adjusting foot placement for different clubs, arc markings for different swing paths, and a plurality of ball placement markers. However, it provides no adjustment for different heights of golfers and spine angle for different stances. U.S. Pat. No. 4,248,431 to Burnes discloses a set of training mats in which the first mat includes a target line and ball position marker while a second mat includes a pattern of footprints to indicate proper foot placement. Separate mats provide additional footprint patterns. However, the '431 patent provides no indicator of proper stance, and no training device or indicator to help develop proper aiming and alignment of the golf shot. U.S. Pat. No. 4,164,352 to O'Brien discloses a golf training mat with a plurality of footprints which are placed in different positions depending on the club being used. Also included are ball placement markings for different ball positions for different clubs. However, it lacks indicia for teaching proper stance and an aiming device to teach how to determine a correct target line. Similarly, U.S. Pat. No. 4,023,810 to Lorang discloses a golf training mat which uses footprints to designate foot position for each club. Measurement indicators are used to show the distance of the golfer from the ball depending on the height of the golfer and club length. However, it does not include any indicator for determining proper target path and any indicator as to setting up proper stance.

Although the prior art makes available numerous golf training aids in the form of training mats, what is lacking in the prior art is a comprehensive training device or combination of devices that can be used by golfers of different heights to learn proper foot position, spine angle as it relates to stance and an aiming device to teach proper alignment and swing path.

SUMMARY OF THE INVENTION

The present invention broadly comprises a mat having an imprinted thereon golf aiming and alignment training pattern. The pattern includes a target line arrow, with the target line arrow having one or more ball position symbols, the center of each ball position symbol located on a center line of the target line arrow, a transverse bar extending in a perpendicular direction from the aiming arrow with the width of the transverse bar substantially equal to the distance between the centers of each of the outer ball position symbols with a pair of cutouts at one end of the transverse bar. In one embodiment, the mat also includes at least one footprint pattern aligned with the target line arrow and one or more eyeline grids used to correct spine alignment to teach a proper stance.

The present invention also includes a golf aiming device that includes a longitudinal portion with a point at a first end, a transverse portion, in which the transverse portion is perpendicular to the longitudinal portion and has at least one transverse end, at least one pair of cutouts, with each one of cutouts located at one of the transverse ends and one or more ball position holes placed substantially within the junction of the longitudinal portion and the transverse portion and aligned such that the center of each of said one or more aiming holes is positioned along the center line of the longitudinal portion. In a preferred embodiment, the golf aiming device includes three ball position holes.

The present invention also comprises a kit for training a user, such as a golfer, proper aim and alignment for a golf swing that includes the golf aiming device, a mat having an imprinted a golf aiming and alignment training pattern, a target line arrow having one or more ball position symbols with the center of each of the ball position symbols located on a center line of the target line arrow.

The present invention also comprises a method for aiming and aligning a golf shot comprising aligning a targeted landing area, an intermediate target, and a golf ball along an imaginary target line, determining a golf club to be used, arranging a foot on or adjacent to one of three imaginary ball lines, with the ball line extending perpendicularly from the golf ball, moving the front foot a prescribed distance toward the targeted landing area and moving the back foot away from the targeted landing area to a desired comfort distance so the front edge of both feet contact an imaginary alignment line parallel to the imaginary target line, and soling the golf club so that the leading edge of the golf club is sitting on and perpendicular to the imaginary target line. A first ball line is functionally related to a golf drive shot, a second ball line is functionally related to a long shot, and a third ball line is functionally related to a short shot.

An object of the present invention is to provide a device that teaches how to establish a proper target line to a target.

A second object of the present invention is to provide a device that teaches proper ball position within a golf stance for different golf clubs.

A third object of the invention is to provide a comprehensive teaching aid that shows in diagrammatic form proper alignment and stance for golfers of different heights and using different types of clubs.

An additional object is to provide a repeatable method for attaining proper foot position for different golf clubs.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiments, it is understood that the invention is not limited to the disclosed embodiments. The present invention is intended to cover various modifications and equivalent arrangements included within the spirit and scope of the appended claims.

The method and devices described below are designed to help a golfer overcome a common misaiming problem, namely the perception that the leading edge of the golf club is correctly aligned with the target line, for example perpendicularly, when in fact it is not. The differences between the correct target line and the target line perceived by most golfers can easily cause an off-target shot. This can lead to unnecessary, and often complicated, changes in a golfer's swing intended to address the perceived problem of off-target shots when in actuality, what may only be needed is a method of discerning the correct target path and the development of an address position and stance that will allow for a swing that follows the correct target line.

Figure 1:
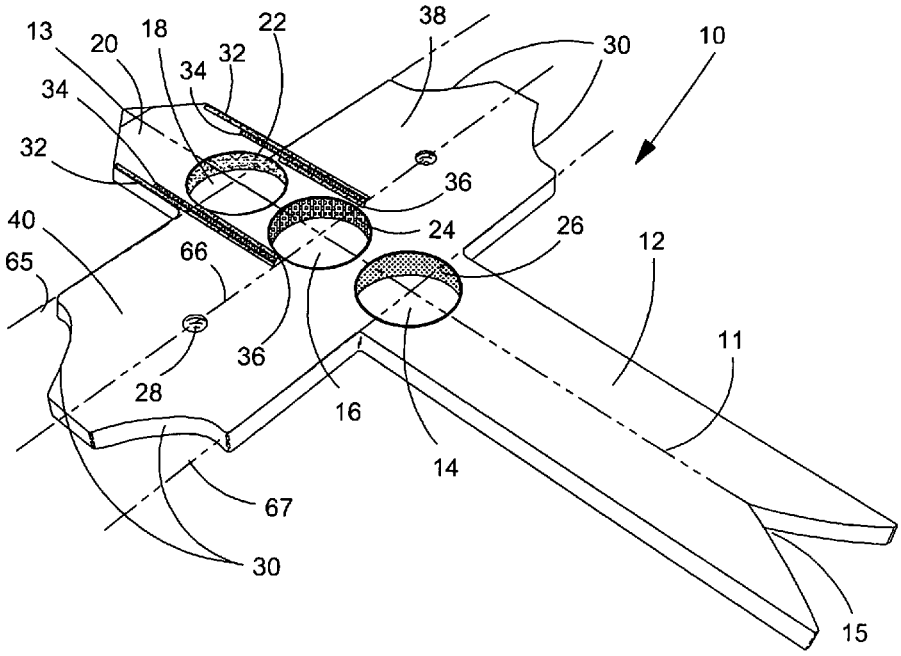
FIG. 1 depicts a top perspective view of the aiming arrow of the present invention.

Adverting to the drawings, FIG. 1 depicts a top perspective view of aiming arrow 10 ("arrow 10"). Arrow 10 comprises longitudinal portion 12 and a transverse portion 40 extending perpendicularly in at least one direction from longitudinal portion 12. In the preferred embodiment shown, transverse portion 40 extends perpendicularly to either side from longitudinal portion 12. One or more ball positions are located substantially within the junction formed by longitudinal portion 12 and transverse portion 40 of arrow 10. In the preferred embodiment shown, the ball positions are holes defined at least partially by longitudinal portion 12. FIG. 1 depicts a preferred embodiment with three ball position holes 18, 16, and, 14 respectively, located substantially within the junction of longitudinal portion 12 and transverse portion 40. Also depicted in FIG. 1 is virtual center line 22 which bisects long portion 12 and also ball position holes 14, 16, and 18. By virtual is meant that the element described as "virtual" or "imaginary" may not be a physical component of the device but is used to aid in describing a particular device, its function, or its method of use. In the preferred embodiment shown, point 13 and notch 15 are formed at opposite ends of long portion 12.

Figure 2:
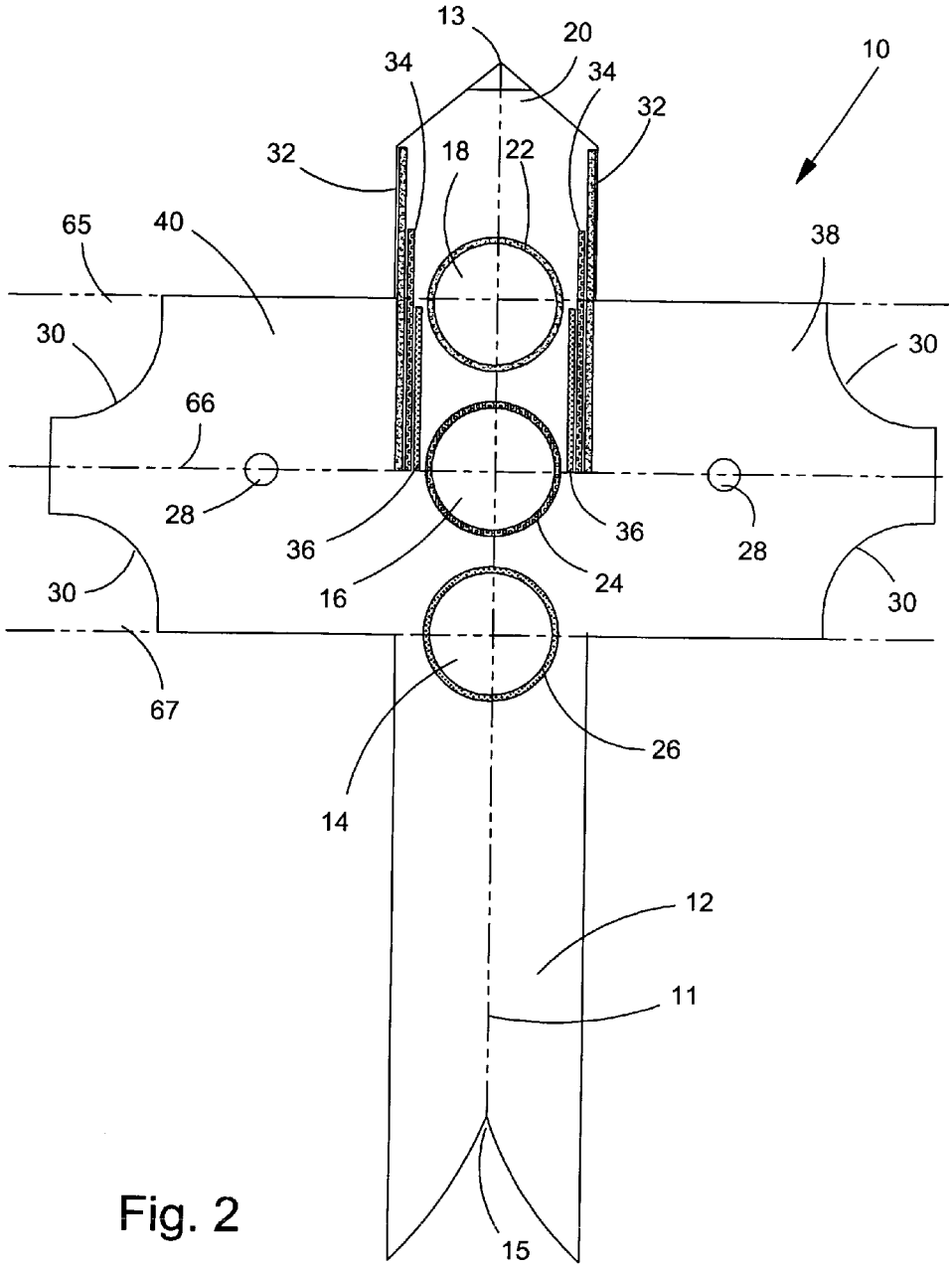
FIG. 2 is a top view of the aiming arrow shown in FIG. 1.

At least one end of transverse portion 40 includes cutouts 30. In the preferred embodiment shown in FIG. 1, cutouts 30 are formed in both ends of transverse portion 40. In a more preferred embodiment, cutouts 30 are generally shaped to conform to the shape of a shoed foot. In the preferred embodiment shown in FIG. 1, ball position holes 14, 16, and 18 are each colored with a separate color as shown by the different shading of the inner walls of each hole. A preferred color set would be red for hole 18, yellow for hole 16 and green for hole 14 although it will be obvious to those skilled in the art that any color scheme is suitable as would ball position holes with the same color. In a more preferred embodiment, arrow 10 will include measuring lines 32, 34, and 36, respectively which, as described below, can be used to aid in establishing a stance for addressing golf balls at each of ball positions 18, 16, and 14, respectively. In a still more preferred embodiment, lines 32, 34, and 36 will have the same color as ball position holes 18, 16, and 14, respectively. FIG. 2 is a top view of arrow 10 showing the same embodiment depicted in FIG. 1.

Figure 3:
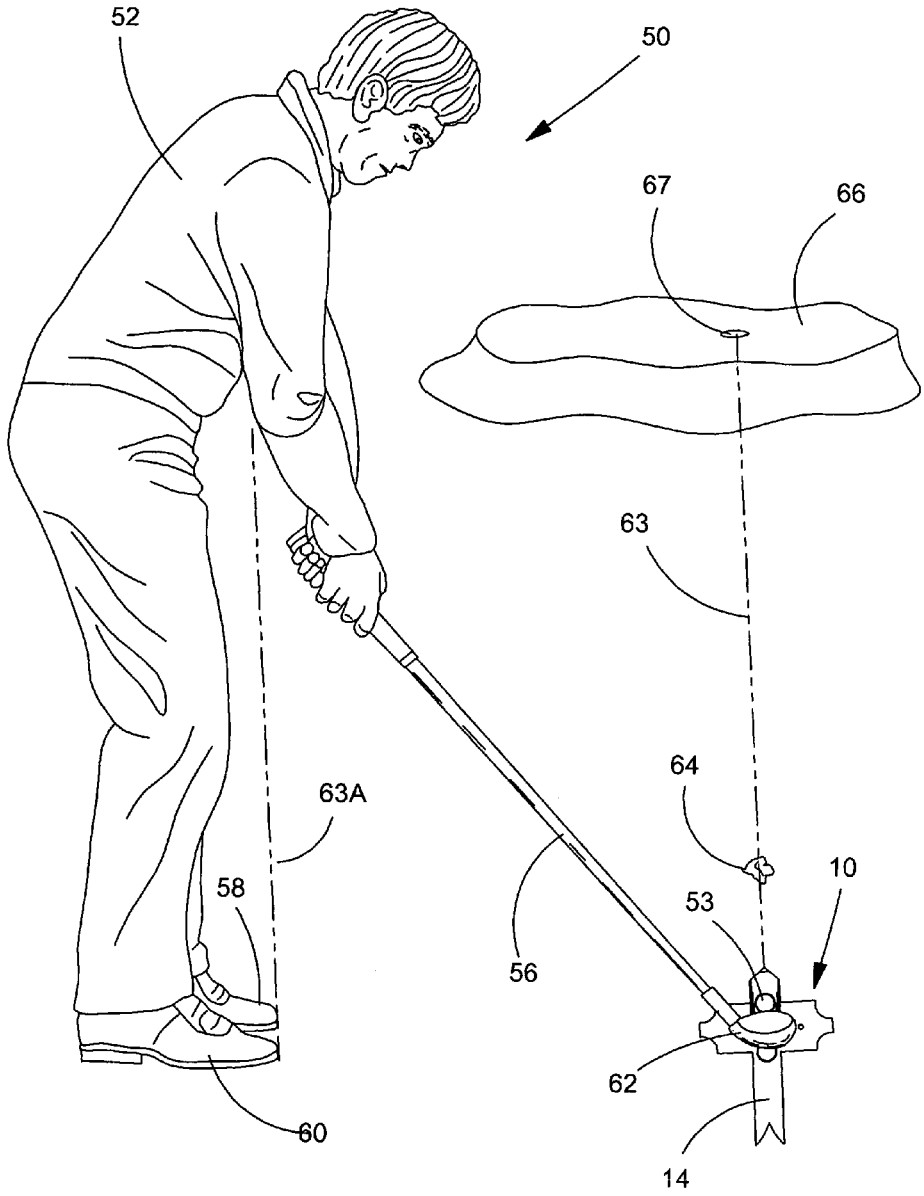
FIG. 3 shows a typical golf set up in which a golfer is shown addressing a golf ball using the aiming arrow of the present invention.

FIG. 3 shows a typical golf set up in which golfer 52 is shown addressing ball 53 using arrow 10. In the representation shown, ball 53 is placed in ball position hole 18 and golfer 52 is using a driver. Target 67 is shown within landing area 66. In the example shown, target 67 is depicted as hole 67 on green 66. Target line 63 is shown as a straight line passing from ball 53 through intermediate target (IT) 64 to ultimate target 67. Preferably, intermediate target 64 is approximately 12-18 inches from ball 53 in such a position that both ball 53 and intermediate target 64 can be seen simultaneously by golfer 52 without turning his/her head. As is discussed below, in a preferred embodiment, the toes of feet 58 and 60 are aligned on imaginary line 63*a* which is parallel to target line 63. Although the primary goal in golf is to put ball 53 in hole 67, it will be recognized by those skilled in the art that target 67, in this case located on green 66, may be some other feature or a specific landing area in a golf fairway.

Figure 4:
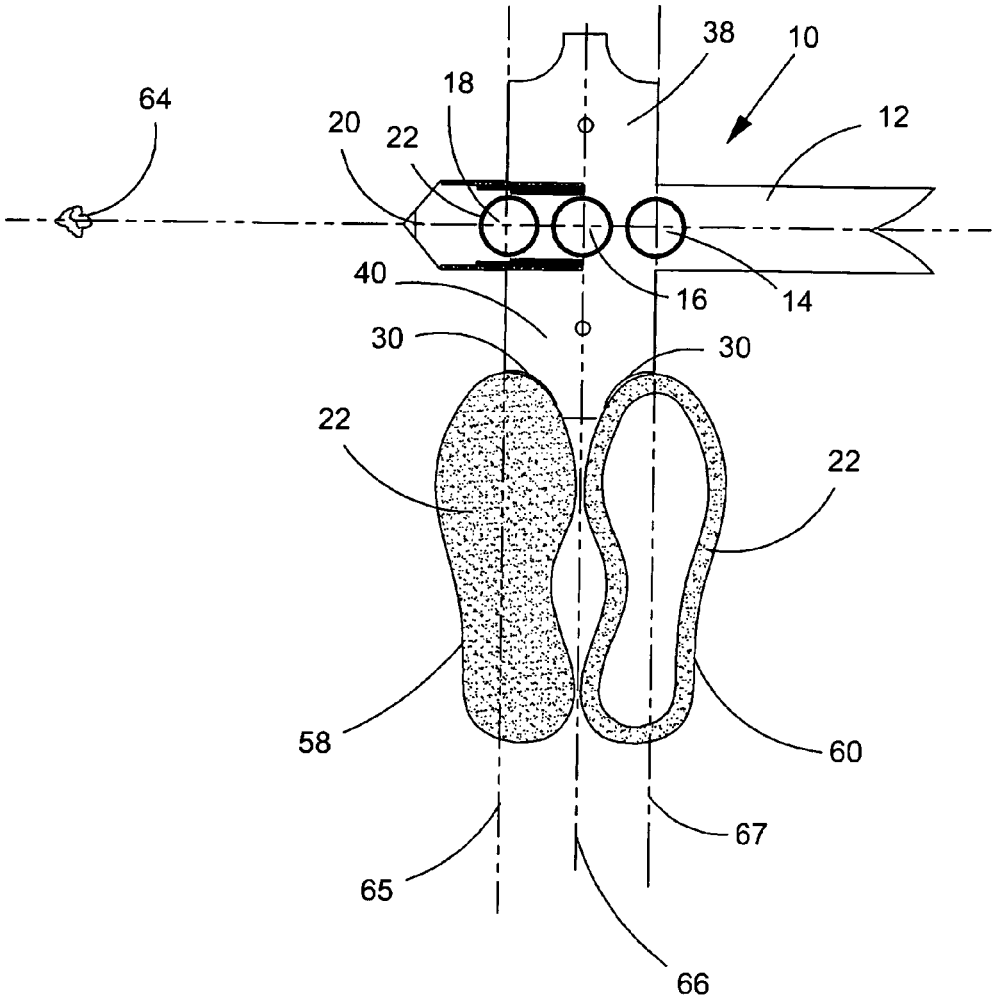
FIG. 4 is a top view of the aiming arrow of the present invention demonstrating a step in the claimed method of aiming and aligning a golf shot showing the forward foot and back foot of a golfer placed within the cutouts.
Figure 5:
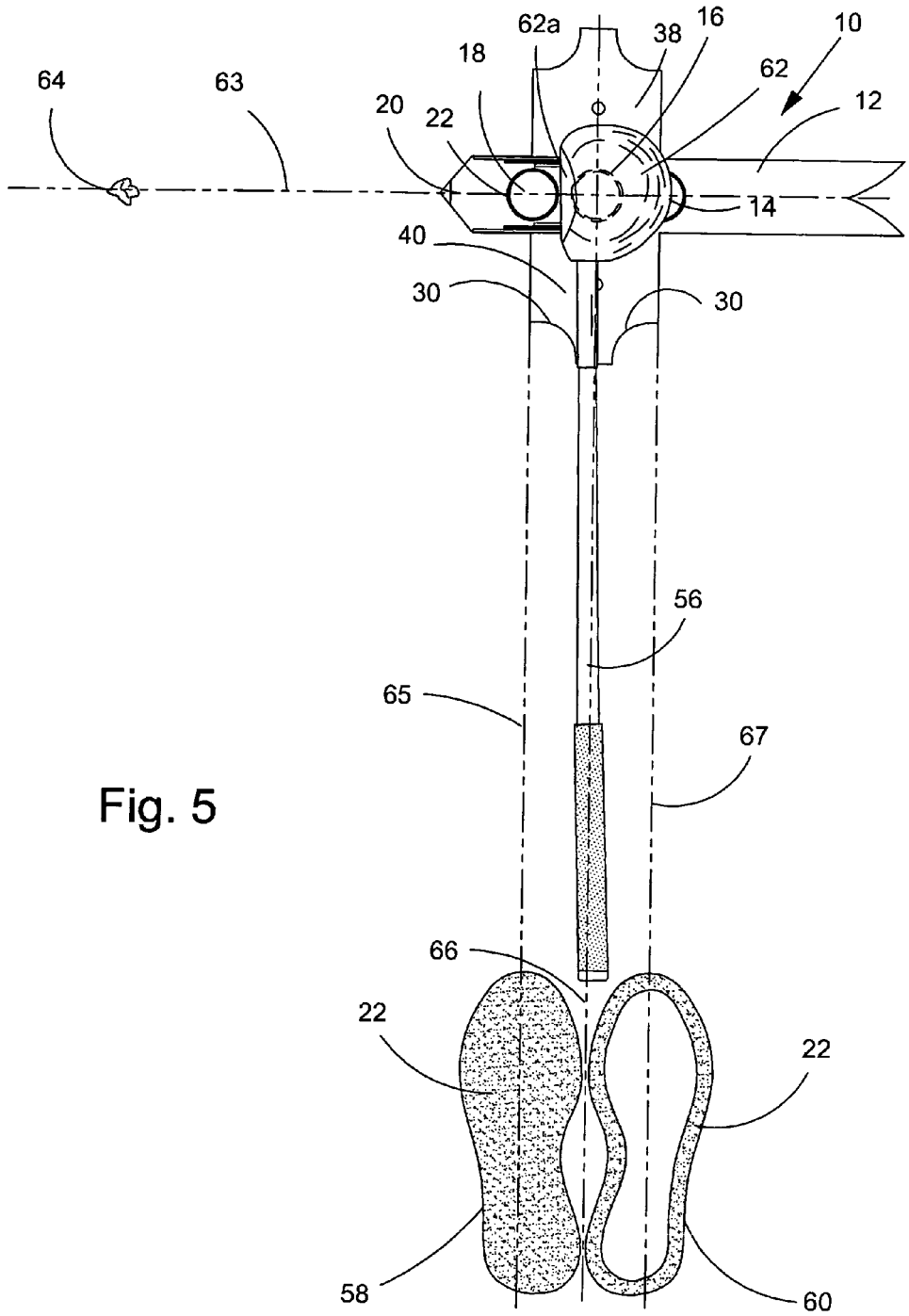
FIG. 5 demonstrates a step in the claimed method showing a top view of the aiming arrow with the feet of a golfer moved into a preparatory position prior to moving into a final address position.

FIG. 4 is a top view of arrow 10 with forward foot 58 and back foot 60 of golfer 52 placed in cutouts 30. By forward is meant the foot closest to target 67. Forward foot 58 is positioned so that the front middle of forward foot 58 is approximately in line with the center of ball position hole 18 along ball line 65, while back foot 60 is positioned such that the front middle of back foot 60 is approximately in line with the center of ball position hole 14 along ball line 67. Ball line 66 is shown passing through middle ball position hole 16 perpendicular to target line 63 and extending between adjacent feet 58 and 60. In FIG. 5, feet 58 and 60 are shown adjacent as in FIG. 4 but removed from arrow 10 in order to address ball 53 (not shown) in ball position hole 18 with club 56. Note that hitting surface 62*a* of club head 62 is substantially perpendicular to target line 63 and is thus parallel to ball lines 65, 66, and 67.

Figure 6:
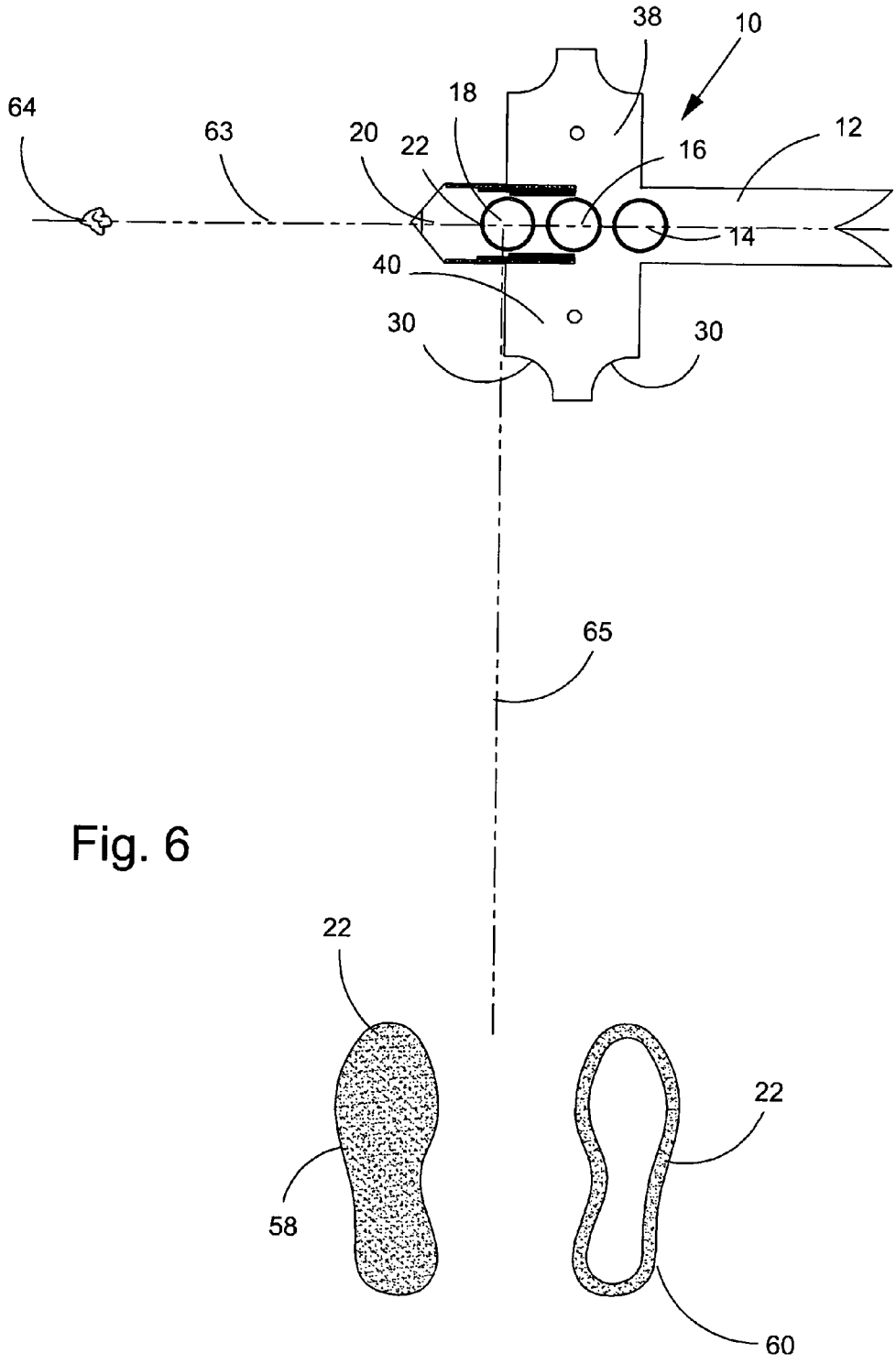
FIG. 6 depicts a step in the claimed method of aiming and aligning a golf shot of the present invention in which the forward foot of a golfer is moved into a final address position.
Figure 7:
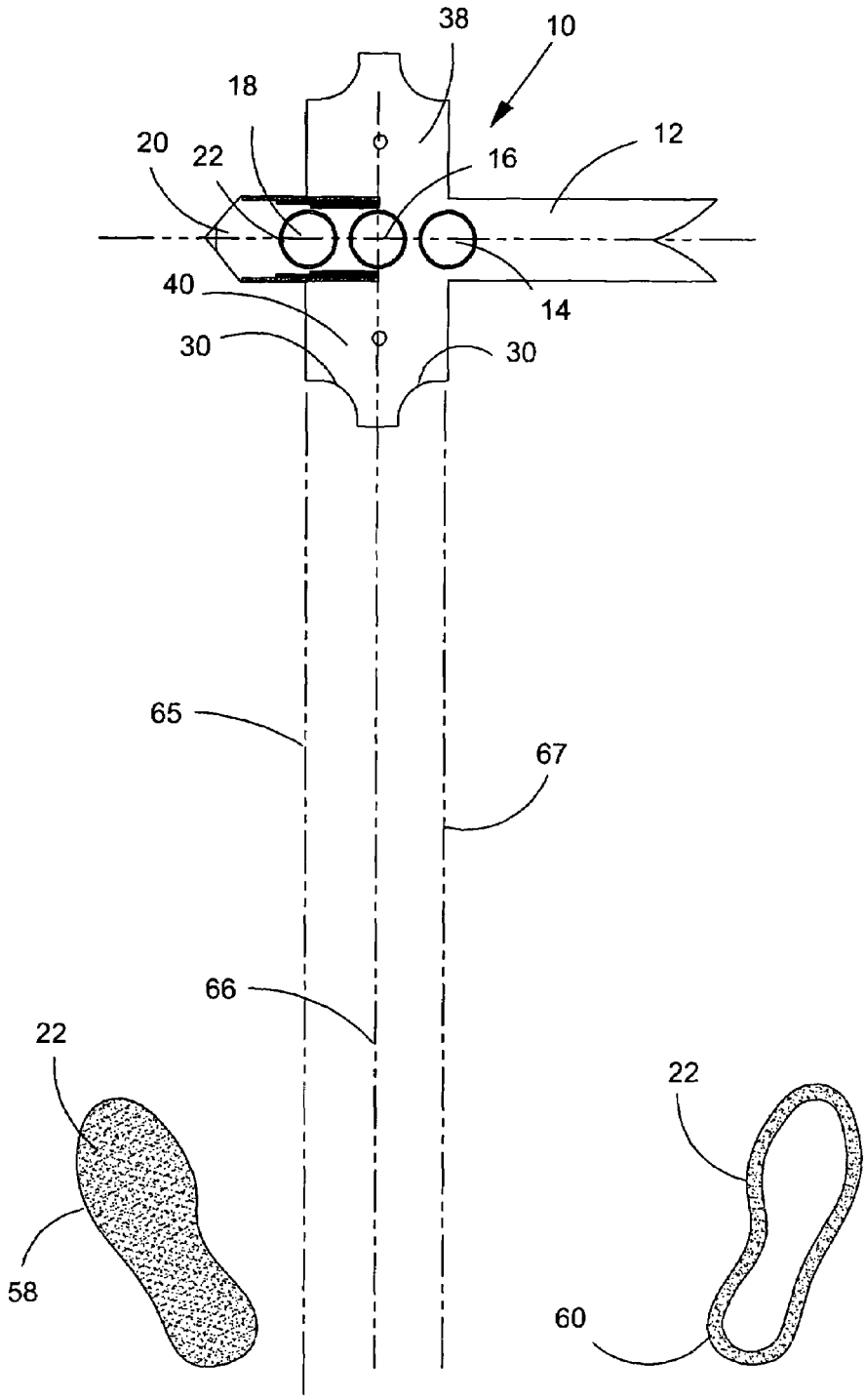
FIG. 7 depicts a step in the claimed method of the present invention in which the back foot of the golfer is in a final address position.

FIG. 6 depicts a succeeding step in addressing ball 53 in which forward foot 58 is advanced about 4 inches toward intermediate target 64 along a line parallel to target line 63. FIG. 7 shows back foot 60 in a final address position such that forward foot 58 and back foot 60 are approximately 17 inches apart and rotated away from each other. Those with ordinary skill in the art will recognize that, as described below, the separation between feet 58 and 60 and the distance of the movement of forward foot 58 toward the target will depend on the type of shot, the club being used, and the height, arm length, and other physical characteristics of golfer 52. In one embodiment, ball position 18 correlates with a drive using a driver, ball position 16 correlates with a long shot using a five iron, and ball position 14 with a short shot using a nine iron.

Figure 8:
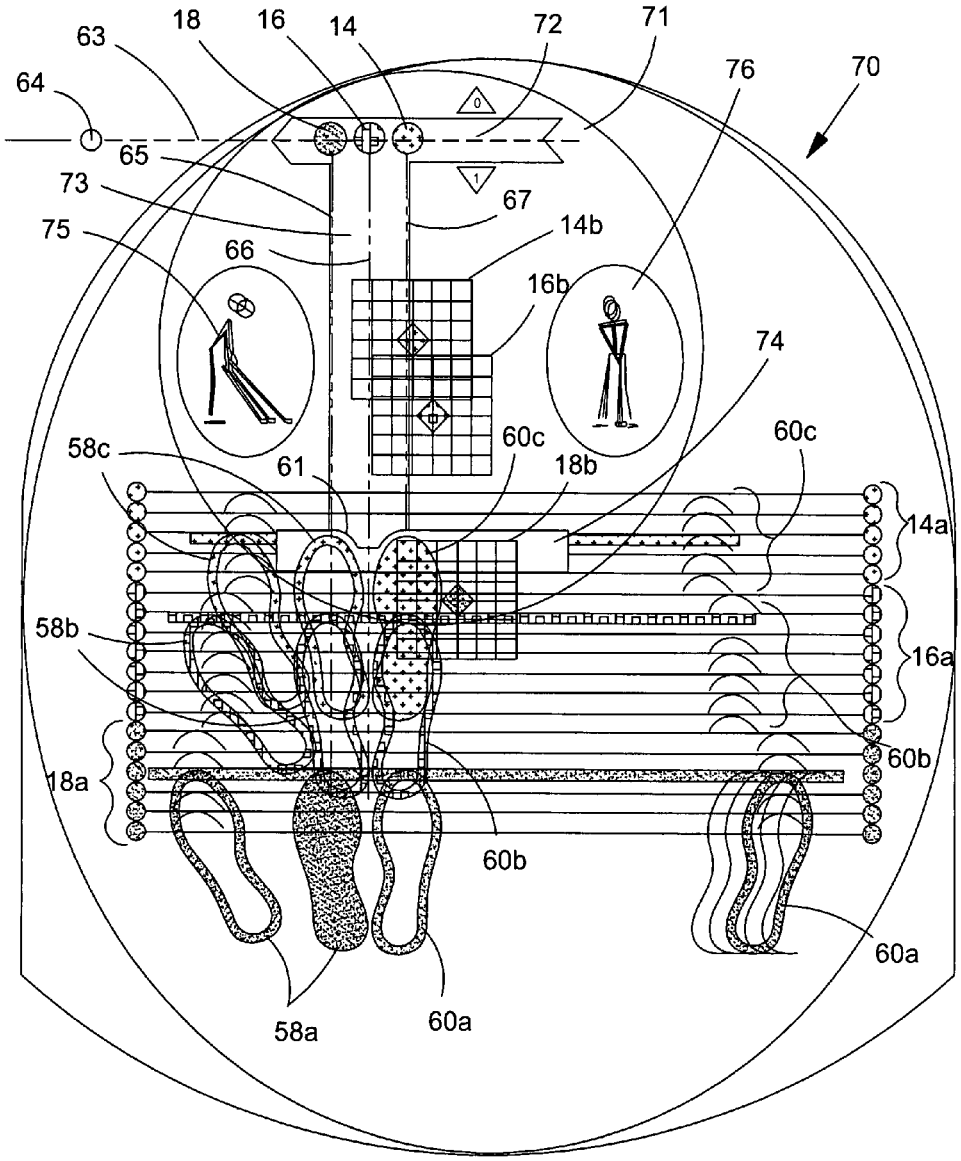
FIG. 8 is a top view of one embodiment of the aiming and alignment training mat of the present invention to be used by a right handed golfer.
Figure 9:
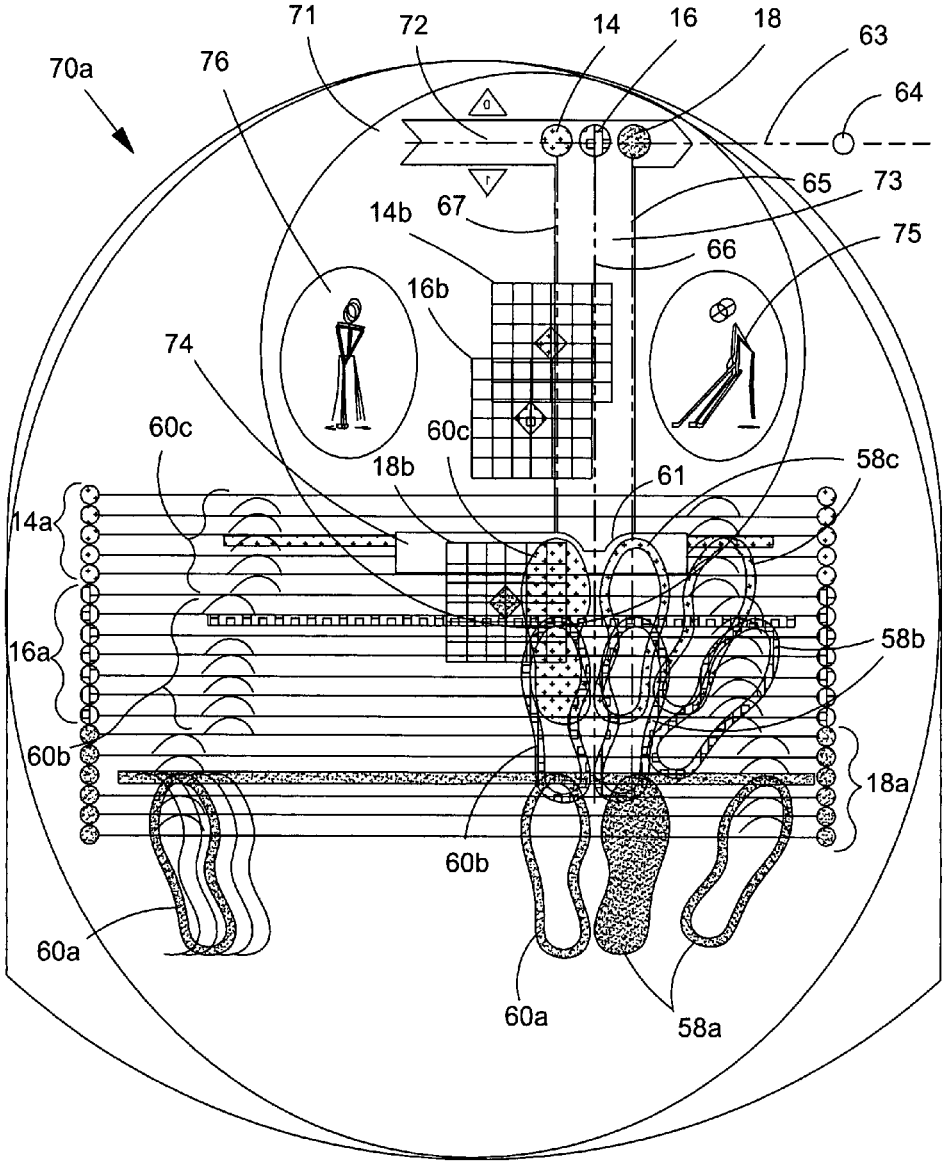
FIG. 9 is a top view of an alternate embodiment of the aiming and alignment training mat of the present invention to be used by a left handed golfer.

FIG. 8 is a top view of aiming and alignment training mat 70 ("training mat 70") to be use for a right handed golfer. FIG. 9 is a top view of training mat 70*a* to be used for left handed golfers. It should be recognized that the description of the features of training mat 70 to be used by a right handed golfer will be similar and often identical to the features of training mat 70*a* for a left handed golfer.

Training mat 70 is an instructional device used to teach proper aim and alignment for a golf student. Proper aim and alignment is desirable to more easily develop a sound golf swing that will allow a golf shot to more closely follow target line 63. It can be seen that training mat 70 incorporates many of the features of arrow 10 to create a more detailed instructional device. H-shaped symbol 71 includes aiming leg 72, cross member 73, and alignment leg 74. It can be seen that ball positions 18, 16, and 14 in aiming leg 72 are analogous to the same numbered positions as seen in arrow 10. Similarly, ball lines 65, 66, and 67 are analogous to the same numbered virtual ball lines as seen in conjunction with arrow 10. Cutouts 61 are seen at one end of cross member 73 ("transverse bar 73).

Training mat 70 is designed to enable a golf student to develop a routine such that he or she will learn to easily move into the desired aiming and alignment position described above by designating proper foot separation in the stance as well as proper ball placement in relation to a golfer's forward foot and chosen club. Ball lines 65, 66, and 67 extend perpendicularly from ball position holes 18, 16, and 14, respectively, and from virtual target line 63 which is formed in part by the centers of holes 18, 16, and 14. If a golf ball is in ball position hole 18, a driver is usually the club to be selected. Using training mat 70, a golfer places forward foot 58*a* along ball line 65 such that forward foot 58*a* is bisected by ball line 65 and places back foot 60 such that it is bisected by ball line 67. Assuming the average foot width is approximately four inches, forward foot 58*a* is moved approximately four inches (the width of foot 58) forward as described above and placed along one of alignment lines 18*a* which are parallel to target line 63 as shown in FIG. 8. This results in placing extended ball line 65 two inches behind the heel of foot 58*a*. Back foot 60*a* is moved so that the width of the stance is slightly wider that shoulder width or a total of about 17 inches with the top of both shoes placed along the same one of alignment lines 18*a*.

Similarly, a five iron is usually the selected club for a ball in ball position hole 16 ("long shot"). Ball line 66 extends between adjacent forward foot 58*b* and back foot 60*b*. To obtain the desired stance, forward foot 58*b* is moved forward about three inches and back foot 60*b* is moved back approximately 15 inches or shoulder width. This movement of forward foot 58*b* results in the heel of forward foot 58*b* placed about three inches from ball line 66. As above, the tips of both foot 58*b* and 60*b* are placed on the same one of alignment lines 16*a* depending on club length and the golfer's height and arm length.

In a similar manner, to hit a nine iron shot ("short shot") from ball position hole 14, back foot 60*c* is bisected by ball line 67 and is adjacent to forward foot 58*c*. Forward foot 58*c* is then moved two inches and placed so that the top of foot 58*c* is resting on one of alignment lines 14*a*. This lateral movement of forward foot 58*c* places the ball approximately four inches from the inside of the heel of forward foot 58*c*. Back foot 60*c* is moved to slightly less than shoulder width or about 13 inches and placed on the same one of alignment lines 14*a*. Therefore, it can be readily seen that the set(s) of alignment lines are in functional association with a particular one of the ball position holes 18, 16, or 14, respectively.

This combination of movements leads to the following procedure for establishing a ball position within the stance:

| Type of Shot | Forward Foot Movement | Heel-to-Ball Line (in inches) |
|---|---|---|
| Drive (Driver) | 4 inches | 2 inches |
| Long Shot (5 iron) | 3 inches | 3 inches |
| Short Shot (9 iron) | 2 inches | 4 inches |

In a preferred embodiment of mat 70, indicia correlated with each of ball positions 18, 16, and 14, such as foot patterns and alignment lines are all of the same color. Thus, for example, foot patterns and alignment lines associated with ball position 18 are all red. In a more preferred embodiment, the associative colors are red, yellow and green for ball positions 18, 16, and 14, respectively. However, it will be recognized by those skilled in the art that any series of colors may be used.

To establish the desired alignment line, club head 62 is placed ("soled") on training mat 70 behind the desired ball position perpendicular to target line 63. Golfer 52 then holds the soled club with the proper grip and notes which alignment line is most appropriate for his/her body characteristics and club length. Eyeline grids 18*b*, 16*b*, and 14*b* are used with ball positions 18, 16, and 14, respectively, to enable golfer 52 to visualize a relatively constant pattern in relation to the ball, the position of the hands from the body, and club length to enable golfer 52 to develop or learn a consistent address position regarding hands, posture and club shaft position. Specifically, golfer 52 can see where the club shaft crosses the appropriate eyeline grid after attaining a proper address position and can use the eye line grid as an aid in determining the spatial relationships among the club shaft, ball, and club head when the golfer places himself/herself in the proper address position to include desired spine angle, angel of feet placement and feet separation and thus weight distribution.

Stance FIGS. 75 and 76 show proper address position for each of the drive, long shot and short shot. In a preferred embodiment, the color of each of the three figures is the same as for the indicia associated with each shot.

FIG. 9 depicts training mat 70*a* showing the same patterns as seen in training mat 70 but arranged for a left-handed golfer. Again, in a preferred embodiment, the indicia associated with a particular ball position will have the same color. In a more preferred embodiment, the patterns for each training mat will be on opposite sides of the same mat.

Figure 10:
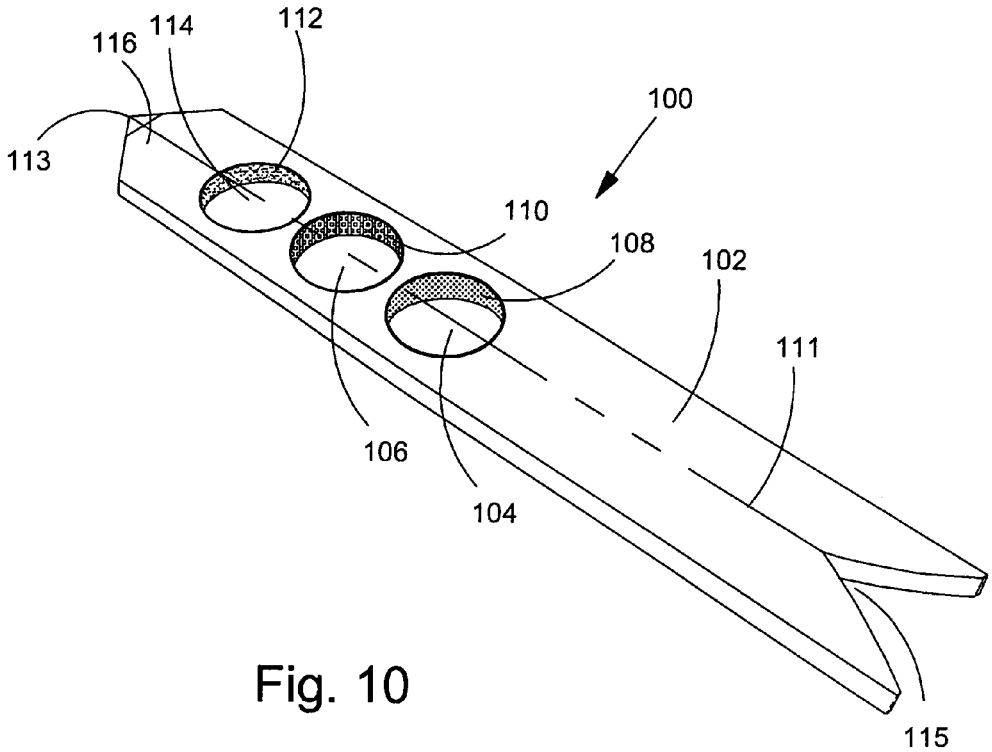
FIG. 10 is a top perspective view of an alternate embodiment of the aiming arrow of the present invention.
Figure 11:
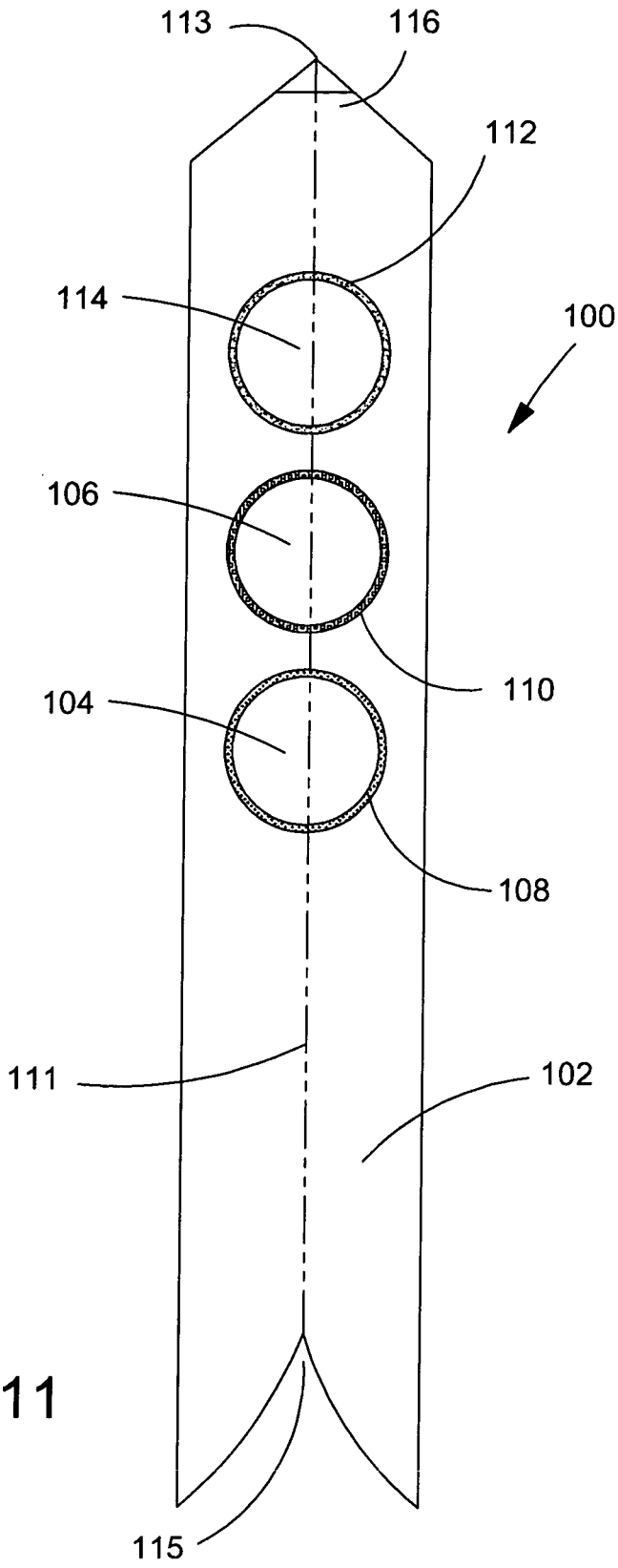
FIG. 11 is a top view of the alternate embodiment of the aiming arrow seen in FIG. 10; and, FIG. 12 depicts a grid superimposed on a top perspective view of an enlarged segment of the aiming arrow of the present invention.

FIGS. 10 and 11 show a modified aiming arrow 100 in which the three ball positions 114, 106, and 104 are shown substantially in the center portion of arrow body 102. In a preferred embodiment, each of the inner walls 112, 110, and 108 possess a different color. In a more preferred embodiment, the colors are red, yellow and green, respectively, for inner walls 112, 110, and 108. Ball position holes 114, 106, and 104 are bisected by center line 111.

Aiming arrow 10, training mats 70, and arrow 100 are used to teach a method of aiming and alignment for a golf shot in which a golfer stands behind the golf ball and establishes an imaginary line in which target 67, intermediate target 64, and ball 53 are all in one line. As can be seen from the configuration of arrows 10 and 100 as well as aiming leg 72, with ball 53 in one of ball positions 18, 16, or 14, the remaining vacant ball positions are also aligned on target line 63. After choosing an appropriate golf club, the golfer arranges his feet on an imaginary ball lines extending from the ball perpendicular to the target line. If the shot is a drive, the front (target side) foot is bisected by the ball line. If it is a long shot as defined above, the ball line extends between the adjacent feet. If is a short shot as defined above, the back foot is bisected by the ball line. As shown in the table above, the front foot is moved an appropriate distance relative to the type of shot. It can be seen that using this positioning method can create a simple technique to determine ball positioning relative to the heel of the front foot. If it is determined for a particular golfer that an extended ball line for a drive should be about 1 inch from the left heel, then it is likely that the ball line should be about two inches away for the long shot and about three inches away for the short shot. Using the feet placement method described, the front foot is moved forward three inches for the drive, two inches for the long shot and one inch for the short shot. These results can be seen in tabular form as follows:

| Type of Shot | Forward Foot Movement | Heel-to-Ball Line (in inches) |
|---|---|---|
| Drive (Driver) | 3 inches | 1 inch |
| Long Shot (5 iron) | 2 inches | 2 inches |
| Short Shot (9 iron) | 1 inch | 3 inches |

Using this easily learned technique, it can readily be seen from both of the above tables that, in general, the length of the forward foot movement for the drive approximately equals the heel-to-ball line distance of the short shot. Conversely, the length of the forward foot movement for the short shot approximately equals the heel-to-ball line distance for the drive. In this technique, for the long shot, the length of the forward foot movement roughly equals the heel-to-ball line distance for the long shot. This technique accommodates any three consecutive reducing numbers with approximately a one inch difference between each number, for example 5, 4, 3; 4.5, 3.5, 2.5; 2, 1, 0.

The ball position holes 18, 16, and 14 in aiming arrows 10 and 100 and aiming leg 71 are also used for teaching a correct swing as they provide visible points along the imaginary target line over which a golfer starts his/her backswing.

Figure 12:
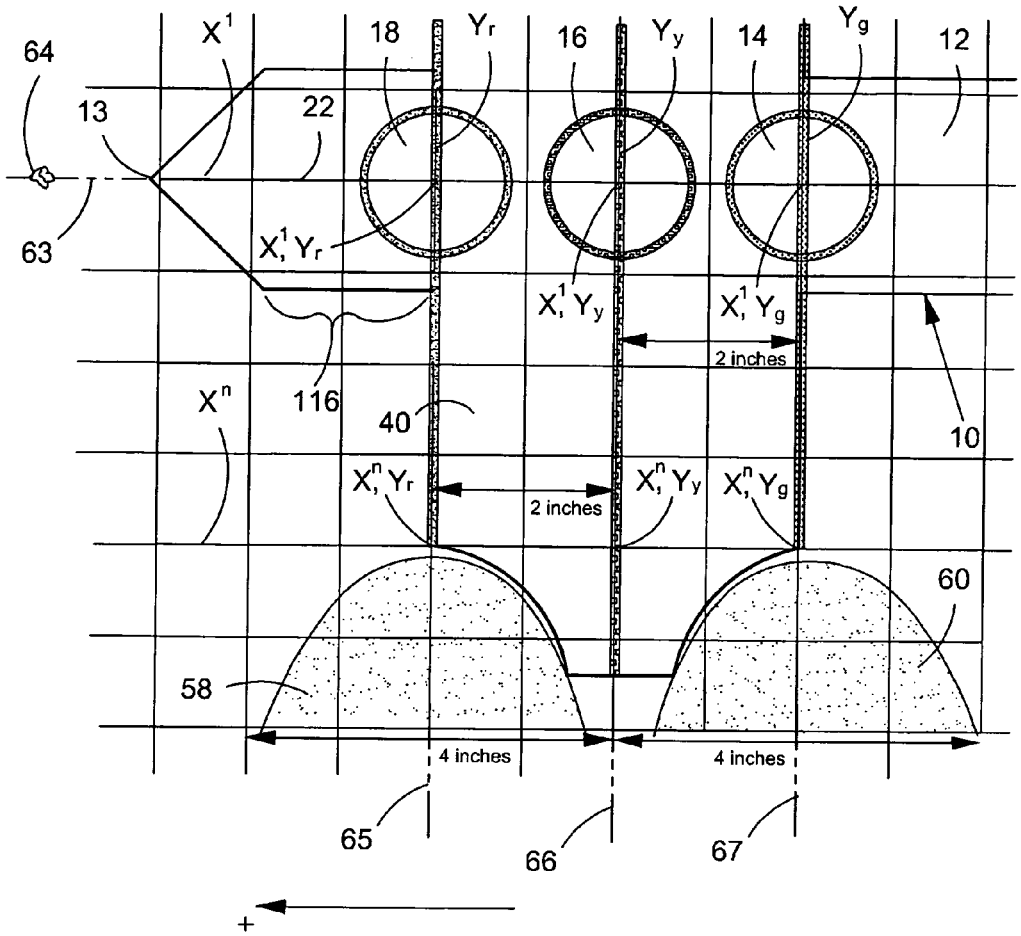

Because the average width of a shoed foot is approximately four inches, it is relatively easy for the golfer to consistently move his feet the correct distance for each type of shot. FIG. 12 depicts a grid superimposed on a top perspective view of an enlarged segment of aiming arrow 10. Using the average foot width of four inches as shown in FIG. 12, the center of ball position holes 18, 16 and 14 are spaced two inches apart. In addition, in a preferred embodiment, length 116 extends two inches from transverse portion 40 to the start of point 13. Therefore, arrow 10 excels as a training device to teach a golfer to attain a correct stance by moving feet 58 and 60 a consistent distance for each type of shot. A golfer and teacher will be able to measure accurate lengths of foot movement using grid points if necessary. For example, for a drive with a ball in ball position 18, a golfer may move foot 58 to point $x_{n+4}$, $y_r$ as the inside heel of foot 58 is moved two inches toward target 67 (not shown in FIG. 12) from ball line 65 and n inches from target line 63 which is also shown as line $x_1$ in FIG. 12. For a long shot, a golfer may move foot 58 forward to point $x_{n+3}$, $y_y$ and for the short shot $x_{n+2}$, $y_g$. In each instance, the "+" symbol indicates movement toward the target by foot 58. Thereafter, when a golfer is on a golf course away from the practice tee and arrow 10 or other training aids, a golfer will have, with practice, the ability to consistently move his/her feet the correct distance apart for each shot.

Thus it is seen that the objects of the invention are efficiently obtained, although changes and modifications to the invention should be readily apparent to those having ordinary skill in the art, which changes would not depart from the spirit and scope of the invention as claimed.

I claim:

1. A mat having imprinted thereon a golf aiming and alignment training pattern, said pattern comprising:

a target line arrow, said target line arrow having one or more ball position symbols, the center of said at least one ball position symbols located on a center line of said target line arrow;

a transverse bar extending in a perpendicular direction from said aiming arrow, said transverse bar having a visible ball line extending the length of said transverse bar from the center of each of said at least one ball position symbols;

a pair of cutouts at one end of said transverse bar; and, at least one foot print outline wherein the middle of said at least one footprint outline is aligned with one of said ball lines.

2. The mat pattern as recited in claim 1 wherein said at least one footprint outline comprises left and right footprint outlines.

3. The mat pattern as recited in claim 2 wherein each of said at least one footprint outline further comprises a third footprint positioned backward of said of ball line.

4. The mat pattern as recited in claim 1 further comprising one or more alignment lines, each of said one or more alignment lines parallel to said center line of said target line arrow; and, at least one foot print outline wherein the middle of said at least one footprint outline is aligned with one of said ball lines.

5. The mat pattern as recited in claim 4 wherein one of said at least one footprint outline is aligned with one of each of said ball lines.

6. The mat pattern as recited in claim 4 wherein said at least one footprint outline comprises left and right footprints.

7. The mat pattern as recited in claim 6 wherein each of said at least one footprint outlines further comprises a third footprint outline positioned backward of said of ball line.

8. The mat pattern as recited in claim 4 wherein each of said at least one footprint outlines further comprises a second footprint outline positioned forward of said ball line aligned with said first footprint outline.

9. The mat pattern as recited in claim 4 further comprising one or more eyeline grids.

10. The mat pattern as recited in claim 1 further comprising one or more eyeline grids.

* * * * *